US005992847A

United States Patent [19]

Beck

[11] Patent Number: 5,992,847

[45] Date of Patent: Nov. 30, 1999

[54] SPINNING DISK GAME

[76] Inventor: Timothy R. Beck, 18950 Marsh La. #701, Dallas, Tex. 75287

[21] Appl. No.: 08/982,948

[22] Filed: Dec. 2, 1997

[51] Int. Cl.[6] ..... A63F 3/00

[52] U.S. Cl. ..... 273/126 R; 273/108.1

[58] Field of Search ..... 273/126 R, 440, 273/459, 461, 447, 108.1, 108.5, 317.6

[56] References Cited

U.S. PATENT DOCUMENTS

| | | | |
|---|---|---|---|
| 2,332,507 | 10/1943 | Dailey . | |
| 2,807,470 | 9/1957 | Keuls . | |
| 3,147,977 | 9/1964 | Glassman . | |
| 3,386,737 | 6/1968 | Burgess | 273/126 R |
| 3,533,626 | 10/1970 | Smith . | |
| 3,680,864 | 8/1972 | Peterson . | |
| 3,939,601 | 2/1976 | Kernell . | |
| 3,947,035 | 3/1976 | Bouchard . | |
| 4,105,210 | 8/1978 | Jones et al. . | |
| 4,257,602 | 3/1981 | Seath . | |
| 4,348,026 | 9/1982 | Kauffmann . | |
| 4,513,964 | 4/1985 | Gunderson | 273/126 R |
| 4,856,790 | 8/1989 | Camillo . | |

*Primary Examiner*—Raleigh W. Chiu
*Attorney, Agent, or Firm*—Dennis T. Griggs

[57] ABSTRACT

A spinning disk game is playable on any flat surface, including a table top as well as a prefabricated game board. The disk playing piece may be a coin, token or specially formed disk having a circular edge that permits it to undergo spinning movement about a vertical axis as it is projected across the playing surface. Spinning motion and linear projection of the disk are produced by manually thumping the disk while it is held upright. If a prefabricated playing board is not available, any movable objects such as slips of paper can be used as targets. Multiple targets are grouped in separate rows and the rows are spaced apart to permit a spinning disk to be projected along a target path lying between adjacent targets of one row to a designated target lying in another row. Various levels of skill and manual dexterity are required to project the disk in upright, spinning motion, to thump the spinning disk to change its trajectory to a designated target, and to seize the spinning disk between a player's two thumbs.

3 Claims, 3 Drawing Sheets

SPINNING DISK GAME

BACKGROUND OF THE INVENTION

This invention relates generally to board games of skill rather than chance, and in particular to a board game which requires manual dexterity for projecting a spinning disk toward a target.

Board games are known in which a playing piece is moved across a playing board toward a target, for example by rolling a disk or cylinder toward a marked score sector as shown in U.S. Pat. No. 4,257,602. Other board games utilize a flat disk which is manipulated by a player's finger for causing the disk to slide on its face across a playing surface into a side pocket or a corner pocket of a playing table, for example as shown in U.S. Pat. No. 3,947,035. Some board games utilize a top game piece which is set into twirling, spinning motion on a spindle, for example as shown in U.S. Pat. No. 4,856,790. According to that patent, the object of the game is to establish and maintain simultaneous spinning movement of several top game pieces. In U.S. Pat. No. 3,680,864, a spinning top game piece is maneuvered across a playing surface by tilting the game board to cause the spinning top to avoid contact with obstacles.

Conventional board games as discussed above require specially formed playing pieces and playing boards that are essential for playing according to relatively complex rules. There remains an interest in providing a simple board game that can played on any flat surface, including a table top or printed playing board, and that can be played with commonly available materials as well as prefabricated game pieces. Moreover, there is a need for a simple board game that appeals to a variety of players, both children and adults, including players possessing different levels of manual dexterity and skill.

BRIEF SUMMARY OF THE INVENTION

The present invention provides a spinning disk game that, according to a set of simple rules, can be played on any flat surface, including a printed game board or a table top. The spinning disk game of the present invention can be played by one or more players and can be adapted to appeal to a variety of players possessing different levels of skill and manual dexterity. The principal components of the game include a disk member, which may be a coin, token or specially formed disk having a circular edge that permits it to be projected, while undergoing spinning movement in response to manually thumping or twirling the circular edge portion of the disk, substantially along a scoring path toward a designated target.

According to one embodiment of the invention, multiple targets are spaced apart on multiple scoring paths on the scoring end of a playing surface, wherein the targets are spaced with respect to each other so that a spinning disk projected along a scoring path to a designated target will touch no other target prior to striking the designated target. The targets are removable pieces on a game board in the preferred embodiment. The game is also playable on a flat table top with an ordinary coin serving as the game piece and slips of paper such as POST-IT™ self-sticking, removable notes serving as targets. Any removable object, for example bottle caps, plastic cups, empty drink containers and the like, may be used as a target.

According to another embodiment, multiple targets are symmetrically spaced with respect to a longitudinal center line of the playing surface and are grouped in separate rows with the targets of each row being spaced apart to permit a spinning disk to be projected along a target path lying between adjacent targets of one row to a designated target lying in another row. The various targets are spaced at different distances with respect to a disk projection base.

According to another aspect of the invention, the disk is initially projected on its edge in spinning motion from a base on the projection end of a playing surface along a first trajectory onto the scoring end of the playing surface, and it is thumped a second time or as many times as necessary while it is spinning upright on the scoring end of the playing surface so that it is projected along a second, third, fourth or fifth trajectory toward a designated target or other scoring indicator.

According to yet another embodiment of the invention, the disk is initially thumped and projected in spinning motion from a base on the projection end of a playing surface to the scoring end of the playing surface. As the spinning disk approaches a designated target, and while the disk remains spinning in an upright orientation, the player seizes the spinning disk between his two thumbs and manually places the disk in contact with a nearby designated target or other scoring indicator, without removing his hands from contact with the playing surface.

The features and advantages of the present invention will be further appreciated by those skilled in the art upon reading the detailed description which follows with reference to the drawings, wherein:

DETAILED DESCRIPTION OF THE INVENTION

Figure 1:
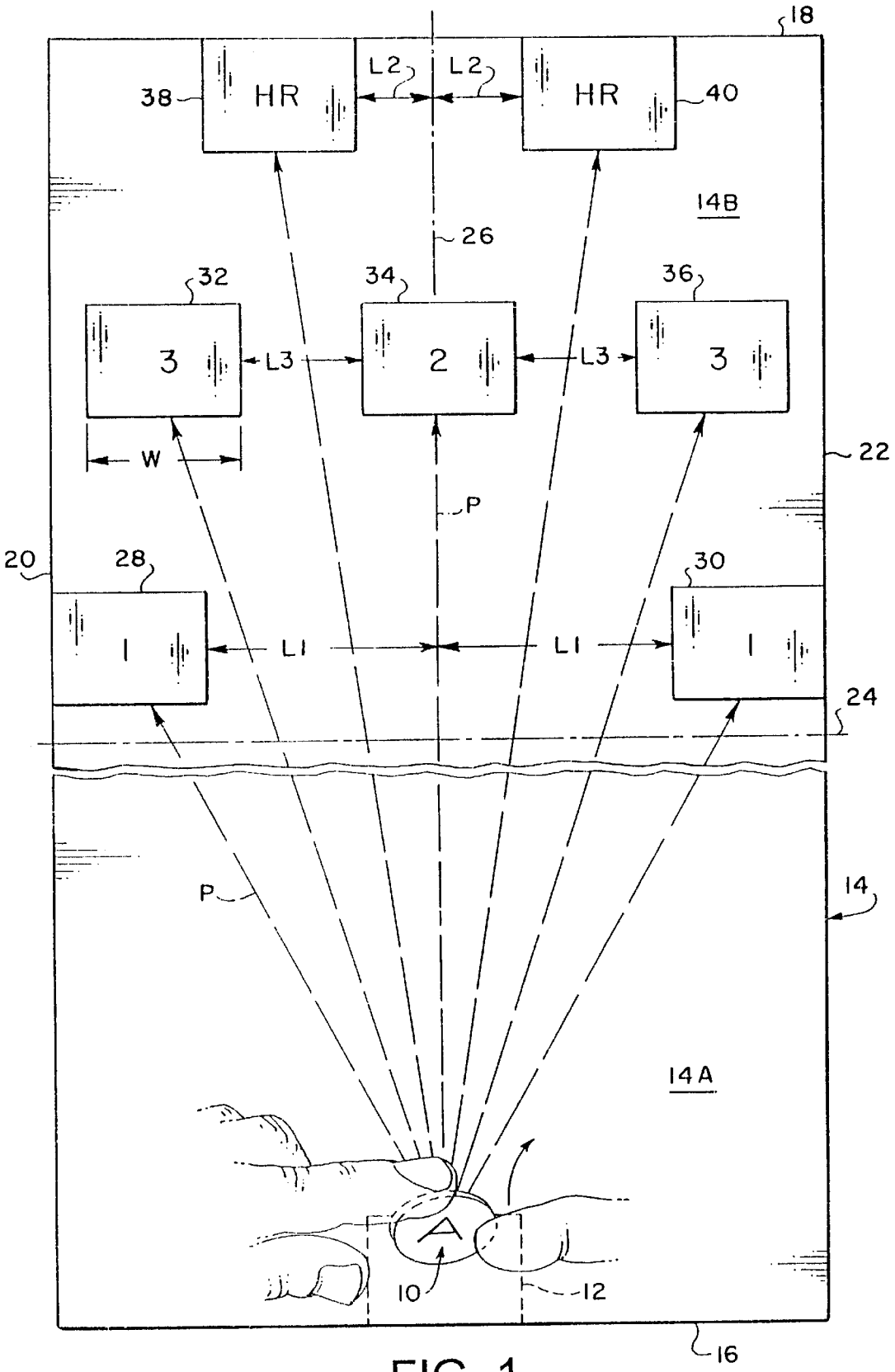
FIG. 1 is a plan view of game board and spinning disk used for playing one embodiment of the invention.

In the description which follows, like elements are marked throughout the specification and drawings with the same reference numerals, respectively.

The various embodiments of the present board game invention accommodate one or more players. When two or more players compete, the play is rotated from player to player until a predetermined score has been achieved.

The spinning disk game of the preferred embodiment is played by thumping a disk 10 while it is being held upright on a projection base portion 12 of a prefabricated playing board 14. The playing board 14 has a first end 16, designated for convenience as a disk projection end, and second end 18, designated for convenience as a scoring end, and left and right side edge portions 20, 22, thus defining a rectangular playing surface. The playing board 14 has a horizontal center line 24 and a longitudinal center line 26. The horizontal center line 24 provides a boundary between a disk projection surface 14A and a scoring surface 14B. The playing surfaces are interchangeable to accommodate two or more players.

As shown in FIG. 1, multiple interchangeable, movable targets are spaced apart on the scoring surface 14B. According to one aspect of the invention, the multiple targets are arranged in rows, with each row including two or more targets that are spaced apart with respect to each other. In the embodiment shown in FIG. 1, targets 28, 30 are symmetrically spaced with respect to the longitudinal center line 26 by spacing distance L1, and together the targets 28, 30 define a first target row.

A second target row is defined by targets 32, 34, 36, with the target 34 being centered on the longitudinal center line 26 and the targets 32, 36 being symmetrically spaced with respect to the center target 34 by a distance L3. The targets 32, 34, 36 are disposed in linear alignment with each other, and thus define a second target row that is longitudinally spaced with respect to the first target row.

Yet another target row is defined by targets 38, 40 which are linearally aligned in a third row that is longitudinally spaced with respect to the second row. Preferably, the targets 38, 40 are symmetrically spaced with respect to the longitudinal center line 26 by a spacing distance L2.

Arbitrary point values (1, 2, 3, HR) are assigned to the targets depending on their spacing distance and angular displacement with respect to the projection base 12. In this particular arrangement, the board game simulates certain aspects of the game of baseball, with the targets 28, 30 each having a point value equal to 1 (referring to first base or single), target 34 having a point value 2 (referring to second base or double), and targets 32, 36 each having a point value 3 (corresponding with third base or triple). Targets 38, 40, being the most difficult to score, are assigned a value of HR (corresponding with home run).

A player advances to a base by thumping the disk 10 so that it is projected across one of the targets. If the disk strikes one of the targets 28, 30 (point value=single), his first man reaches first base. If his next disk projection strikes one of the targets 32, 36 (point value=triple), his first man on first base will advance three bases and score a run, and his second man will advance to third base. The first player will continue to shoot toward the targets until he misses the targets three times. The players will then rotate the board or adjust the targets for the second player to take his turn. For scoring purposes, the men on the simulated bases may only advance as far as the target value that is struck by the man following him. For example: the first man hits a "single" target and next man strikes a "double" target. The first man moves two bases to third base and the man who hits a double target moves to second. In the play of a two-player game, the opposing player keeps track of men on base, disks that do not hit targets ("outs") and scores.

According to one aspect, the horizontal spacing distances L1, L2 and L3 are not equal, providing variable width scoring paths between adjacent targets in each row. The relative difficulty of striking a particular target can thus be adjusted to accommodate the skill levels of different players. Moreover, the targets may be arranged randomly without establishing any particular pattern or spacing for increased difficulty of play.

In the preferred embodiment, the disk 10 is constructed of a plastic material such as polycarbonate or any other durable material such as aluminum or wood. It has a diameter of 1¼ inches (diameter tolerance±¼ inch), an edge thickness of ⅛ inch (edge dimension tolerance ±1/32 inch), and weighs approximately 2 ounces (weight tolerance ±0.5 oz). If a prefabricated disk is not available, an ordinary coin, for example a U.S. quarter, can be used instead. Likewise, if a prefabricated playing board is not available, the targets are preferably formed by rectangular slips of paper such as POST-IT™ self-sticking, removable notes.

Preferably, the targets have a width W, and the spacing distance L3 is substantially equal to or less than the width dimension W. Other target spacing distances can be used, either greater or smaller, to make the play of the game more or less difficult. The targets may be moved randomly and placed without establishing rows or patterns on the scoring end of the board. For simulating the play of baseball, there should be at least four targets on the board at all times (one for each point value). The targets may be re-arranged after each player takes a turn.

Referring again to FIG. 1, the targets are angularly displaced with respect to each other and are longitudinally spaced at different spacing distances from the projection base 12. Each target lies on a projection path as indicated in phantom by the dashed lines P. The targets may be moved to create a more difficult game. When slips of paper are used to form the targets, the level of play difficulty can be adjusted by moving the targets closer to the longitudinal center line, and further apart from each other and from the projection base 12.

Figure 2:
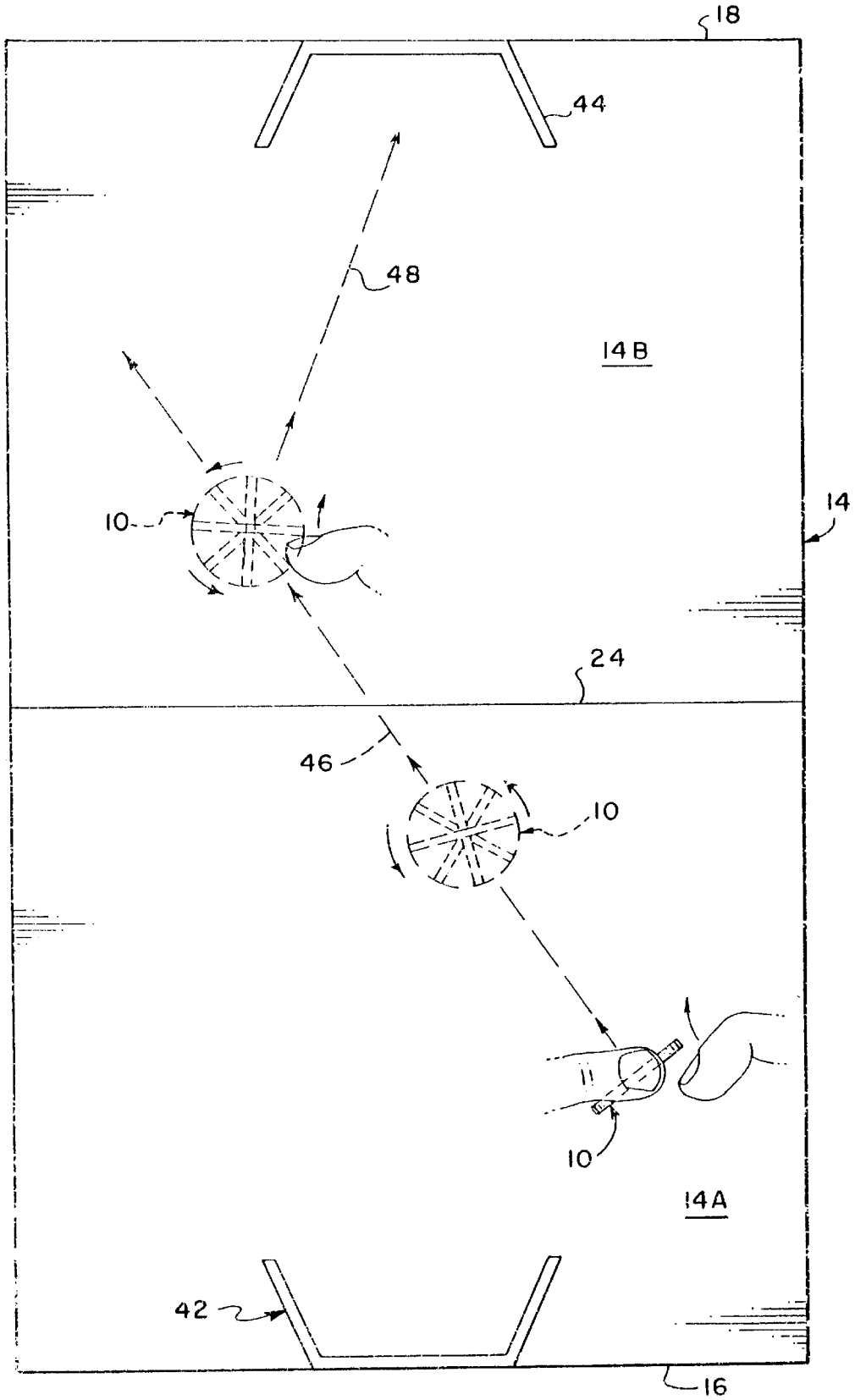
FIG. 2 is a plan view showing a game board and spinning disk as used for playing an alternative embodiment of the invention.

The arrangement shown in FIG. 2 is set up to simulate the game of hockey. The simulated hockey game is played on the same prefabricated playing board 14 and includes an open target goal 42 located on the playing surface 14A and an open goal 44 located on the playing surface 14B at the opposite end of the playing board. According to the play of the simulated hockey game, two players sit at opposite ends of the playing board, and the first player holds the disk 10 in an upright orientation and thumps it with his finger to cause it to follow a first trajectory path 46 which brings it close to the target goal 44.

According to the rules of the simulated hockey game, the first player then thumps the spinning disk 10 while it remains spinning upright on the playing surface 14B and projects it along a second trajectory 48 toward the open target goal 44. The disk may be thumped as many times as needed to score a goal, as long as the disk continues to spin. The first player continues to thump the spinning disk until it stops spinning, leaves the table or enters the target goal. The disk 10 is returned to the first player each time a goal is made. However, the playing turn is given to the second player if the disk leaves the board or stops spinning. The second player then follows the same procedure, with the players alternating turns until one of them achieves a predetermined total score. The simulated hockey game can be played by only one player and on a tabletop instead of a playing board.

Figure 3:
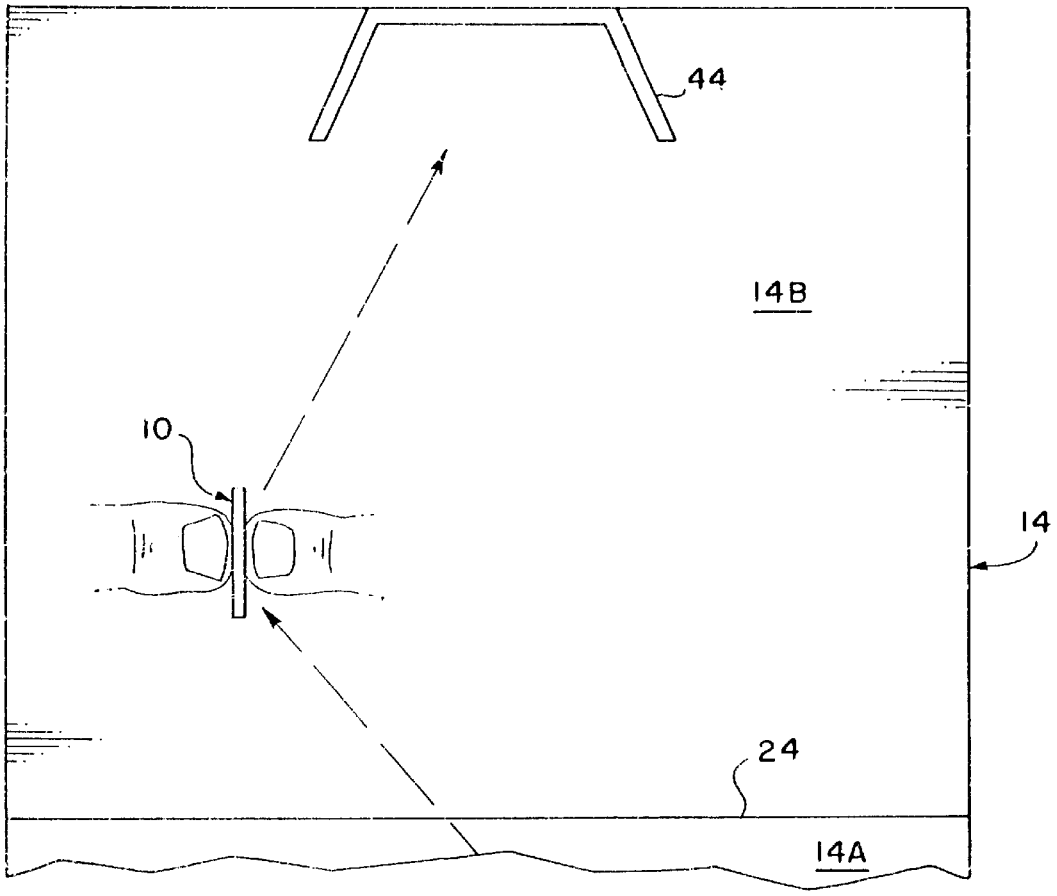
FIG. 3 is a plan view similar to FIG. 2, illustrating yet another embodiment of the invention.
Figure 4:
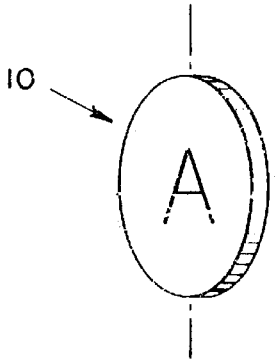
FIG. 4 is a left side perspective view showing the preferred form of a disk member which constitutes the principal playing piece of the invention.
Figure 5:
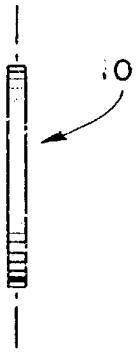
FIG. 5 is a left edge elevational view thereof, the right edge elevational view being a mirror image thereof; and, FIG. 6 is a right side perspective view of the disk playing piece.
Figure 6:
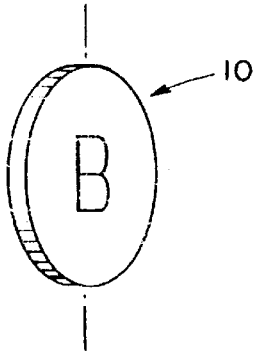

Referring now to FIG. 3, a alternative version of the spinning disk game is played on the same playing board or playing surface, with the open target goals 42, 44 representing basketball goals. In the play of this simulated basketball game, the players take turns projecting the disk 10 in spinning motion toward one of the open goals 42, 44. As the spinning disk nears an open goal, the player seizes the spinning disk 10 between his two thumbs and then manually places the disk into contact with the open target goal while maintaining his hands in contact with the playing surface.

Although the open target goals 42, 44 are shown as replaceable parts of the prefabricated playing board 14, other scoring indicators can be used, for example the opposing player's cupped hand, or the goal may be simulated by an open container lying on its side, for example a cup.

The invention has now been described with reference to certain rules that simulate the play of baseball, hockey and basketball. The rules of play can be extended to simulate the play of other games in which a spinning disk is projected toward a target.

I claim:

1. A method for playing a game on a flat playing surface having a projection end and a scoring end with a circular disk playing piece comprising:

projecting the disk along a scoring path extending from the projection end of the playing surface to a designated target on the scoring end of the playing surface by holding the disk upright with its circular edge on the projection end of the playing surface and thumping or twirling the disk so that it is projected while undergoing spinning movement on its edge substantially along the scoring path toward the designated target.

2. A method for playing a spinning disk game as set forth in claim 1, including the step of thumping the spinning disk while it is spinning upright on the scoring end of the playing surface so that it is projected along a second scoring path toward a designated target.

3. A method for playing a spinning disk game as set forth in claim 1, wherein the disk is initially thumped and projected from a base on the projection end of a playing surface to the scoring end of the playing surface, and while the spinning disk approaches a designated target, including the step of seizing the spinning disk between the player's two thumbs and manually placing the disk in contact with a nearby designated target or other scoring indicator, without the player removing his hands from contact with the playing surface.

* * * * *